US006676434B2

(12) United States Patent
Ushio et al.

(10) Patent No.: US 6,676,434 B2
(45) Date of Patent: Jan. 13, 2004

(54) CONNECTOR FOR PRINTED CIRCUIT BOARDS

(75) Inventors: Kohei Ushio, Hyogo (JP); Toshiaki Horii, Nisshin (JP); Ryoichi Kawamoto, Kurayoshi (JP); Takaaki Makita, Torrori (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 63 days.

(21) Appl. No.: 09/989,177

(22) Filed: Nov. 21, 2001

(65) Prior Publication Data

US 2002/0061673 A1 May 23, 2002

(30) Foreign Application Priority Data

Nov. 22, 2000 (JP) ..... 2000-356515

(51) Int. Cl.[7] ..... H01R 13/627
(52) U.S. Cl. ..... 439/357; 439/352
(58) Field of Search ..... 439/352, 354, 439/357, 350; 438/249

(56) References Cited

U.S. PATENT DOCUMENTS 3,154,365 A * 10/1964 Crimmins ..... 439/496
3,813,634 A * 5/1974 Wigby et al. ..... 439/459
5,302,140 A * 4/1994 Arnett ..... 439/557
5,389,006 A * 2/1995 Noschese ..... 439/354
5,915,987 A * 6/1999 Reed et al. ..... 439/258
6,146,179 A * 11/2000 Denny et al. ..... 439/350

* cited by examiner

*Primary Examiner*—Tho D. Ta
*Assistant Examiner*—James R. Harvey
(74) *Attorney, Agent, or Firm*—Antonelli, Terry, Stout & Kraus, LLP

(57) ABSTRACT

A connector (11) for printed circuit boards has a housing (13) narrow and elongate to hold a few contacts (12), a pair of lockable elastic legs (15) disposed at lower end regions of opposite lateral walls (14) of the housing and protruding sideways, and locking pawls (16) formed integral with the respective elastic legs. A pair of supplementary lugs (17) formed integral with upper end regions of the lateral walls (14) also protrude sideways the same distance as the pawls, so that when the connectors are driven forth within a magazine case (25), the neighboring supplementary lugs (17) will contact each other simultaneously as the neighboring pawls (16) jostle one another, protecting the connectors from tilting, and thus delivering them in line and in an ordinarily way.

2 Claims, 6 Drawing Sheets

CONNECTOR FOR PRINTED CIRCUIT BOARDS

FIELD OF THE INVENTION

The present invention relates to a connector for printed circuit boards such that a magazine case can be loaded therewith allowing each of them to smoothly move through the case.

PRIOR ART

In order to supply an automatic feeder or the like apparatus with the connectors, a number of them have sometimes been accommodated in a magazine case. A few or several magazine cases have been put in the automatic feeder in a sequential manner so as to deliver successively the connectors to any desired destination.

Shown in FIG. 8, are the prior art connectors 1 intended for use in printed circuit boards and each having one pin contact 2 fixed in a narrow and elongate housing 3. However, those housings 3 usually have each a pair of lockable elastic legs 5 disposed at lower end regions of opposite lateral walls 4 and 4 in each housing. The legs 5 have locking pawls 6 protruding sideways therefrom in opposite directions. Distance 'A' between those pawls 6 is larger than width 'B' of the body of housing 3, so that when feeding the connectors 1 through the magazine case 7 said pawls 6 belonging to two adjacent connectors are likely to abut each other. Those connectors 1 will thus tilt back and forth, with their corners colliding with the inner surface of the magazine case 7. In such an event, they could hardly move through the case smoothly, thus causing it to be jammed with the connectors.

SUMMARY OF THE INVENTION

An object of the invention made to resolve this problem in the prior art is therefore to provide, for use in printed circuit boards, a connector that will not tilt back and forth in a magazine case, never jamming or clogging it with the connectors.

In order to achieve this object, a connector provided herein for printed circuit boards does comprise, as in the prior art ones, a housing that is designed narrow and elongate to hold therein one to three contacts, a pair of lockable elastic legs disposed at lower end regions of opposite lateral walls of the housing and protruding sideways in opposite directions, and locking pawls formed integral with the respective elastic legs. The connector of the invention does further comprise characteristically a pair of supplementary lugs disposed at upper end regions of the lateral walls and also protruding sideways the same distance as the locking pawls.

A plurality of this type connector may also be transported through a magazine case. Those supplementary lugs belonging to adjacent connectors and disposed at the lateral walls thereof will then come into mutual contact, simultaneously with the locking pawls also colliding with each other. By virtue of such a behavior of those parts, the connectors will never tilt at all in the magazine case but will advance smoothly in row in an orderly way.

The connector of the invention is designed in particular as a one-pole type connector that accommodates therein only one contact. However, the present invention may also apply to other connectors of the two-pole type or several-pole type insofar as these connectors whose housings are so narrow and elongated that they are more or less likely to tilt within a magazine case.

THE PREFERRED EMBODIMENTS

Figure 1:
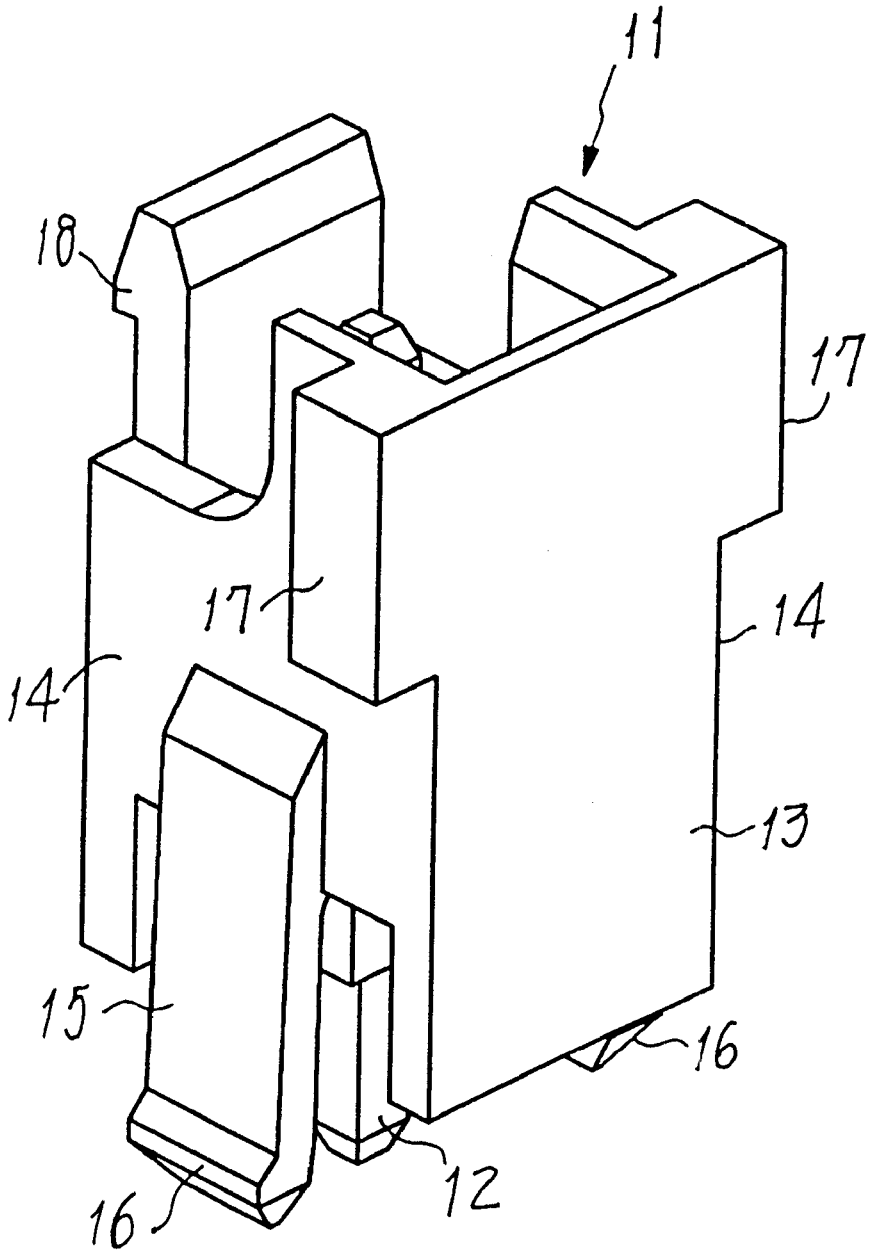
FIG. 1 is a perspective view of a connector provided herein for use with printed circuit boards.
Figure 2:
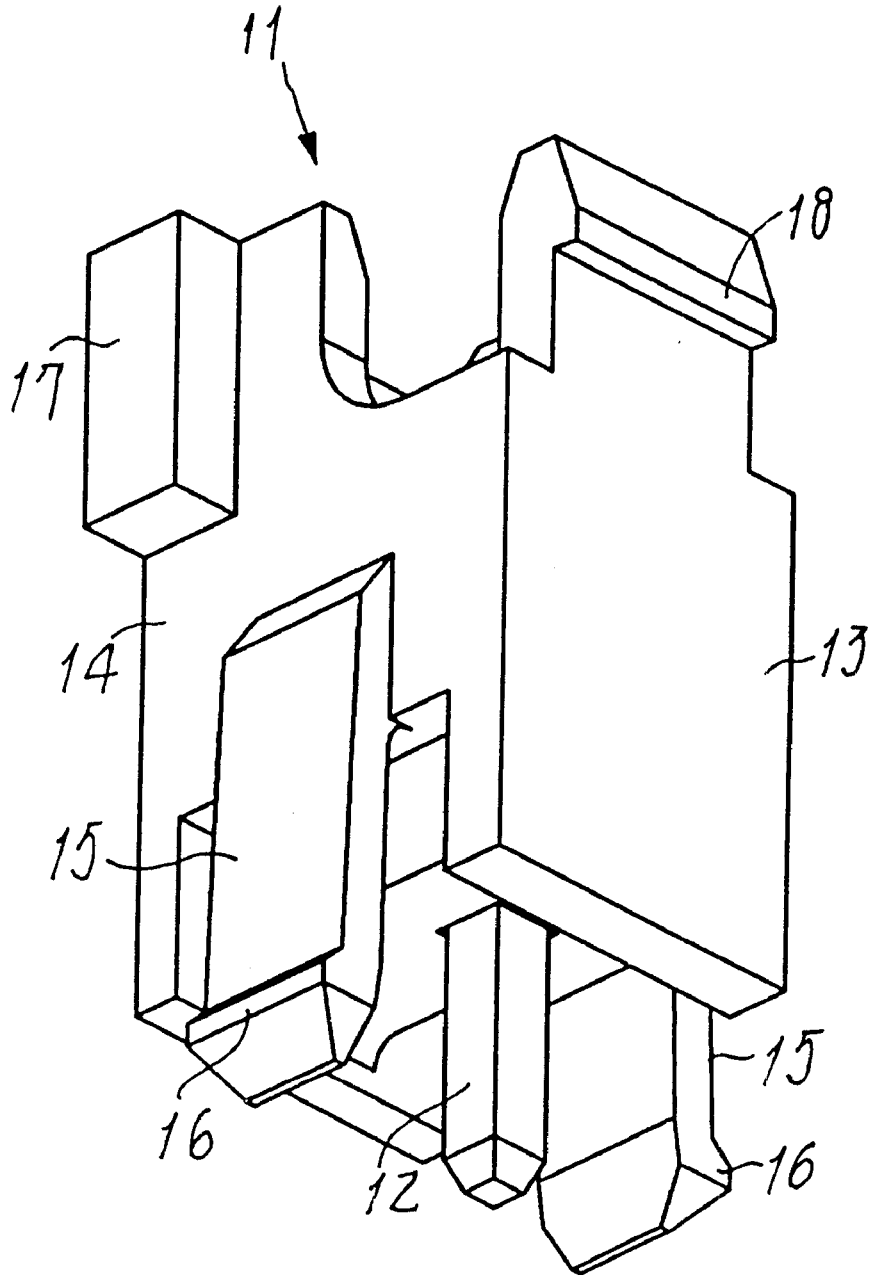
FIG. 2 is another perspective of the connector seen upwards from its bottom.

Now, some preferred embodiments will be described below, referring to the drawings.

Figure 7:
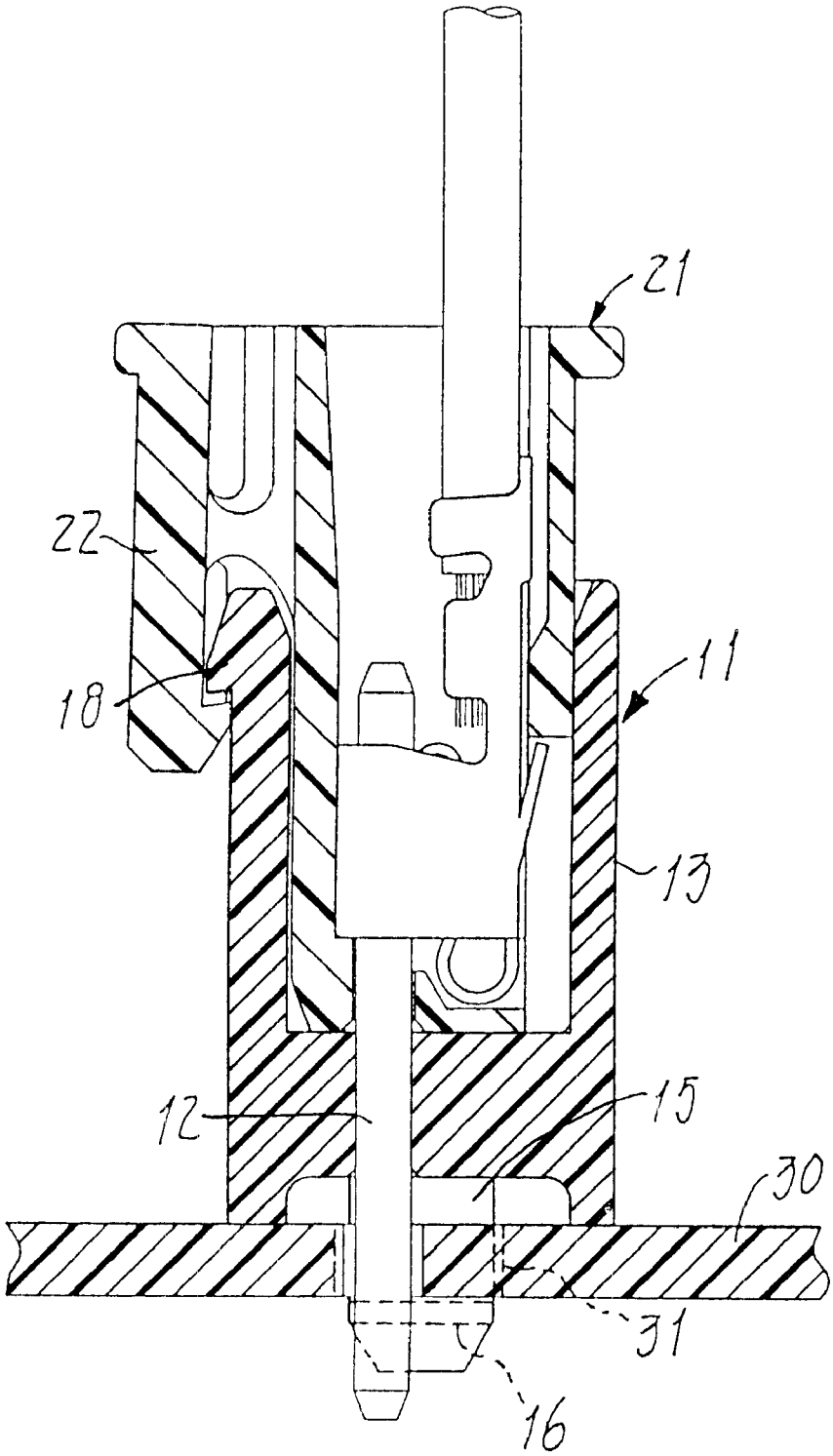
FIG. 7 is a vertical cross section of the connector surface-mounted on a printed circuit board.
Figure 8:
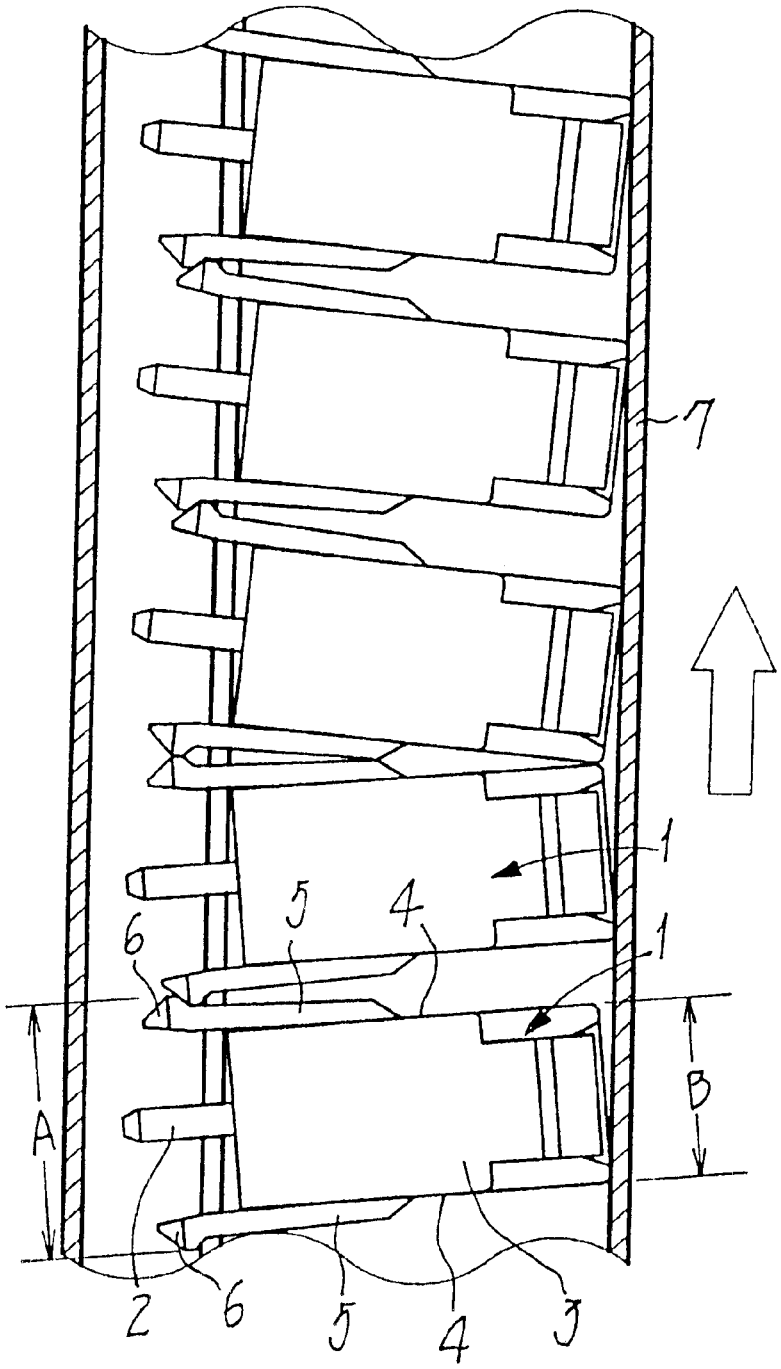
FIG.8 (PRIOR ART)
FIG. 8 is a horizontal cross section of the magazine case in which the prior art connectors are being transported towards the destination.

FIGS. 1 to 4 show a connector 11 for printed circuit boards. This connector is of the one-pole type, and comprises a housing 13 that holds fixedly therein a pin contact 12 protruding outwards through a bottom of said housing. A pair of lockable elastic legs 15 disposed at lower end regions of opposite lateral walls 14 of the housing 13 protrude sideways in opposite directions and extend downwards. Those legs serving to prevent the connector from slipping off do have locking pawls 16 also protruding sideways therefrom in opposite directions. FIG. 7 shows the connector 11 surface-mounted on a printed circuit board 30, and as seen in this figure each lockable elastic leg 15 is inserted in a positioning hole 31 formed in the circuit board 30. In this state, the pawls 16 are locked in situ by this circuit board so as not to allow the housing 13 from slipping off it. To render flexible the elastic legs 15 to fit in the holes, they are cantilevered to protrude from the lateral walls 14.

Figure 3:
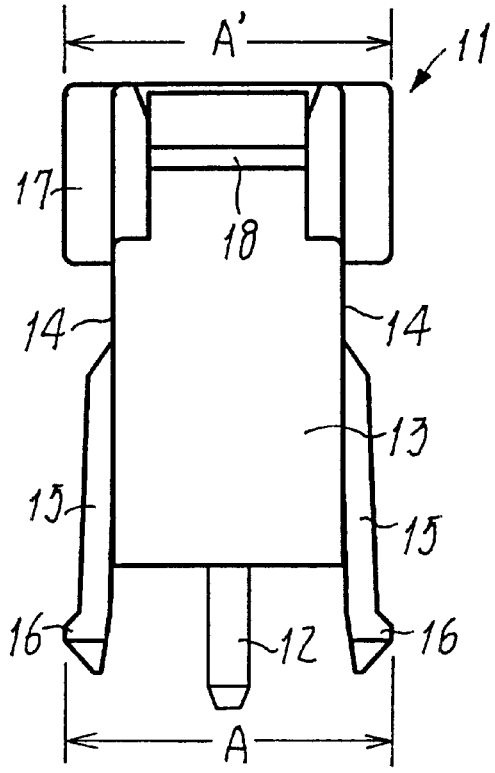
FIG. 3 is a front elevation of the connector.
Figure 4:
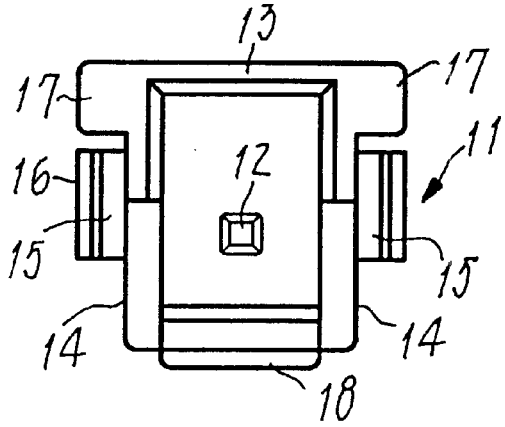
FIG. 4 is a plan view of the connector.

A pair of supplementary lugs 17 are disposed at upper end regions of the lateral walls. These supplementary or auxiliary lugs 17 also protrude sideways the same distance as the locking pawls 16. Thus as shown in FIG. 3, a distance 'A' between the lugs 17 is made substantially equal to another distance 'A' by which the pawls are spaced from each other.

The reference numeral 18 denotes a further locking pawl formed integral with the upper end of a front wall of the housing 13. When surface-mounting the connector as shown in FIG. 7, this further locking pawl 18 will engage with a lockable arm 22 of a mating connector 21.

Figure 5:
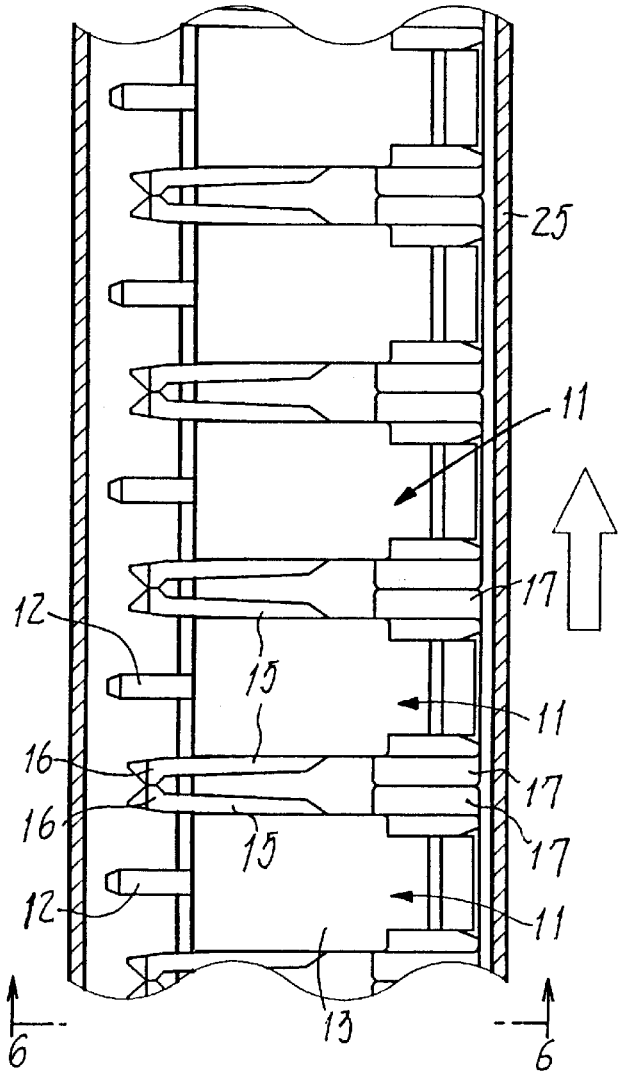
FIG. 5 is a horizontal cross section of a magazine case in which the connectors of the invention are being transported towards a destination not shown.
Figure 6:
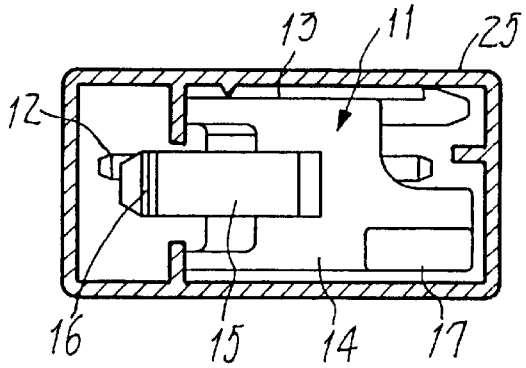
FIG. 6 is a vertical cross section taken along the line 6—6 in FIG. 5.

The connectors 11 of the described structure may be accommodated in and transported through a magazine case 25, in a manner as seen in FIGS. 5 and 6. As these connectors are driven to advance within the case, the supplementary or auxiliary lugs 17 adjacent to each other will come into mutual contact simultaneously as the locking pawls 16 of the neighboring connectors 11 jostle one another. Thus, the connectors are driven forth in line and in an ordinarily way, without any fear of stagnation within the magazine case 25.

It will now be apparent that, despite a simple incorporation of those supplementary lugs to be integral with the lateral wall upper regions, the present invention has succeeded to prevent the connectors from tilting in and jamming the magazine case, and to thereby enhancing smoothness in feed of them.

What is claimed is:

1. A connector for printed circuit boards comprising:

a housing having a width, a depth and a length perpendicular to and longer than the width and the depth, the housing holding therein at least one contact having a longitudinal axis extending in the length direction, a pair of lockable elastic legs disposed at lower end regions of opposite lateral walls of the housing and protruding sideways in opposite directions along the width direction of the housing perpendicular to the length direction, the elastic legs having locking pawls formed integral with the respective elastic legs, and a pair of supplementary lugs disposed at and integral with upper end regions of the lateral walls, the supplementary lugs protruding sideways in opposite directions along the width direction perpendicular to the length direction, and a distance that the supplementary lugs protrude being substantially the same as a distance that the locking pawls project.

2. A connector as defined in claim 1, wherein one pin contact is accommodated in the housing.

* * * * *